United States Patent [19]

Prieur

[11] Patent Number: 5,048,122

[45] Date of Patent: Sep. 17, 1991

[54] GARMENT FOR SHIELDING LINES CONNECTED TO A PATIENT

[76] Inventor: Deborah G. Prieur, 327 Asbury St., Hamilton, Mass. 01982

[21] Appl. No.: 532,339

[22] Filed: Jun. 4, 1990

Related U.S. Application Data

[63] Continuation of Ser. No. 297,086, Jan. 13, 1989, abandoned.

[51] Int. Cl.[5] ..... A41D 13/00; A41D 11/00

[52] U.S. Cl. ..... 2/69; 2/80; 2/83; 2/111; 2/114; 2/247; 2/250; 2/DIG. 6; 2/DIG. 7; 604/174; 604/175; 604/345

[58] Field of Search ..... 2/69.5, 69, 70, 79, 2/80, 83, 111, 112, 113, 114, 247, 248, 249, 250, 251, 252, DIG. 6, DIG. 7; 604/174, 179, 345

[56] References Cited

U.S. PATENT DOCUMENTS

| | | | |
|---|---|---|---|
| 1,260,873 | 3/1918 | Coleman | 2/111 X |
| 1,758,740 | 5/1930 | Gale | 2/80 X |
| 2,437,989 | 3/1948 | Artzt et al. | 2/113 X |
| 2,588,542 | 3/1952 | Kunz | 2/80 |
| 2,652,057 | 9/1953 | Siegal et al. | 2/80 X |
| 2,663,873 | 12/1953 | Stern | 2/83 |
| 3,023,419 | 3/1962 | Strahle | 2/80 X |
| 4,578,062 | 3/1986 | Schneider | 604/174 |
| 4,582,508 | 4/1986 | Pavelka | 604/179 |
| 4,637,075 | 1/1987 | Ingrisano et al. | 2/247 X |
| 4,666,432 | 5/1987 | McNeish et al. | 450/89 X |
| 4,688,270 | 8/1987 | Denicola et al. | 2/102 |
| 4,698,848 | 10/1987 | Buckley | 2/114 |
| 4,718,124 | 1/1988 | Sawicki et al. | 2/114 |

FOREIGN PATENT DOCUMENTS

| | | | |
|---|---|---|---|
| 746958 | 3/1956 | United Kingdom | 2/69.5 |
| 2001237 | 1/1979 | United Kingdom | 2/251 |

*Primary Examiner*—Werner H. Schroeder
*Assistant Examiner*—Jeanette E. Chapman
*Attorney, Agent, or Firm*—Pearson & Pearson

[57] ABSTRACT

A garment to be worn by a person with an implanted catheter line. The garment includes a close fitting garment body that is easily donned and includes a pocket on an inside surface thereof adjacent the site of the catheter implant. The pocket stores a portion of the catheter line during normal activities of the person and includes closure means for partially closing the pocket. For certain patients the garment includes double closures that inhibit the wearer from opening the garment once it is donned.

12 Claims, 3 Drawing Sheets

*Fig.1.*
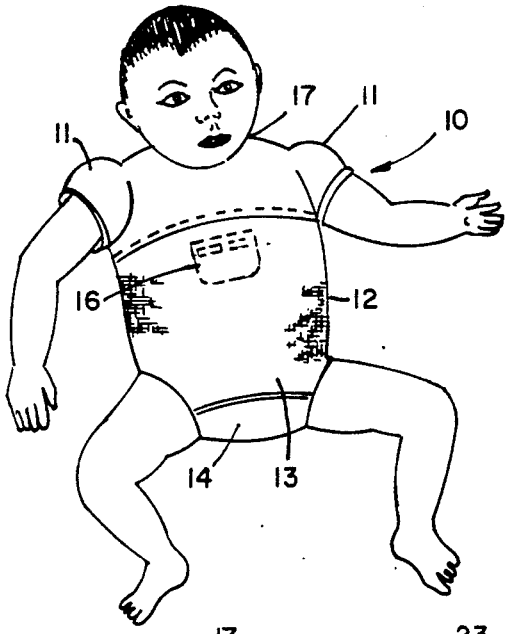
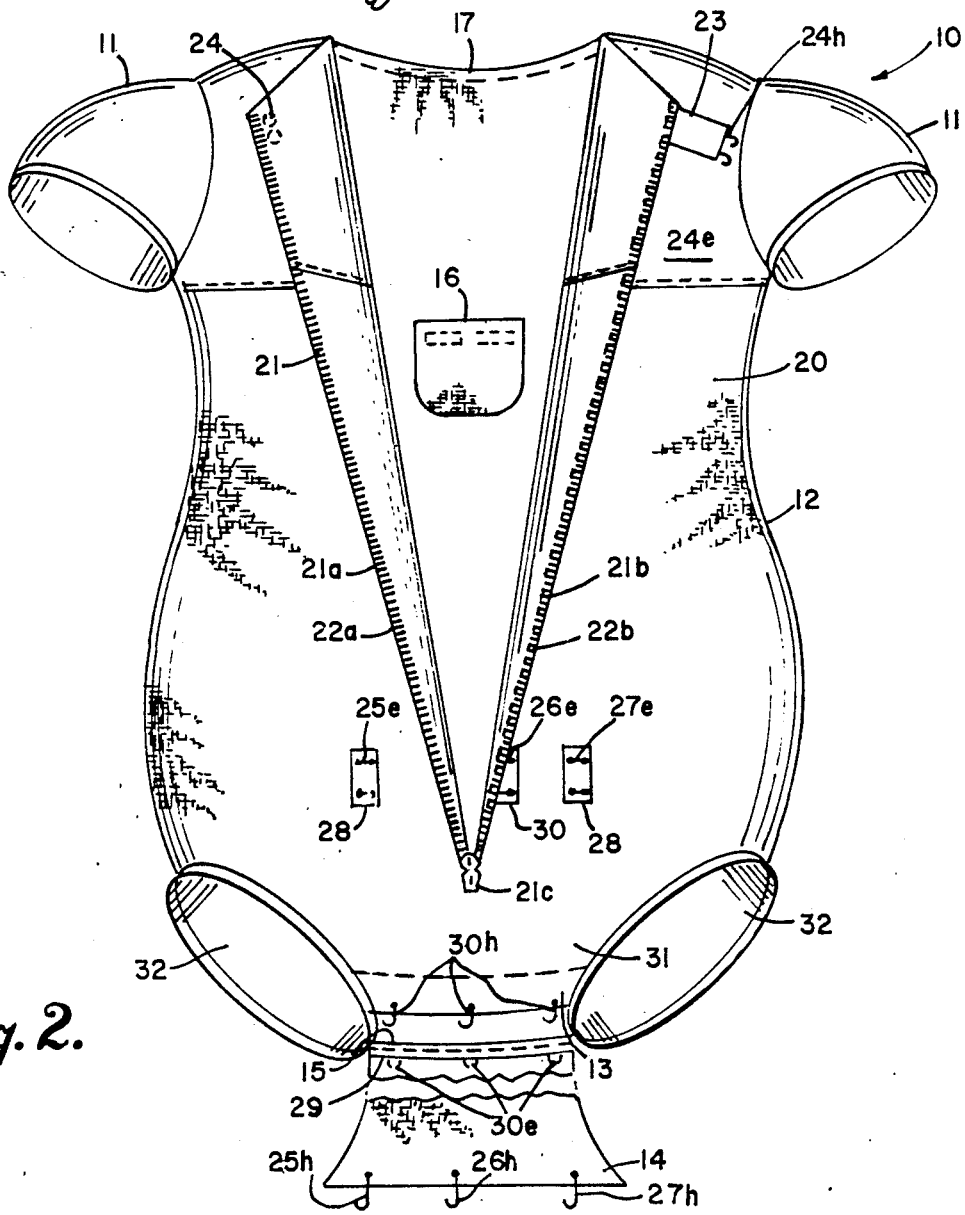
*Fig. 2.*

Fig. 4.
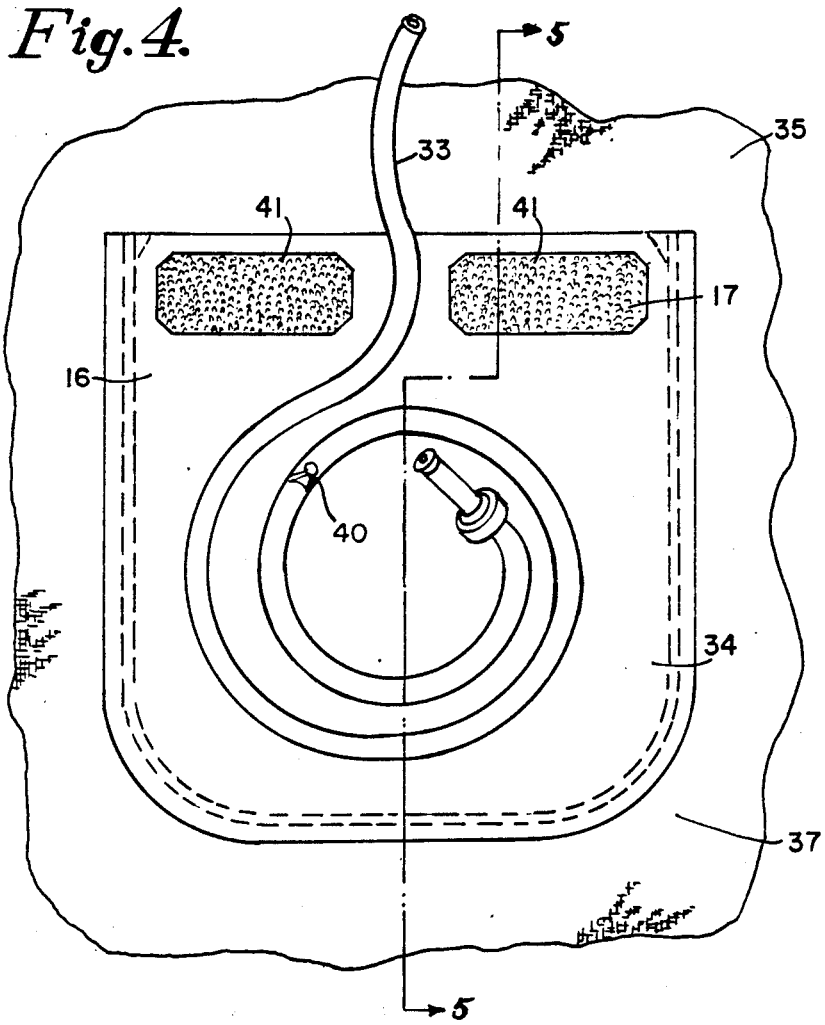
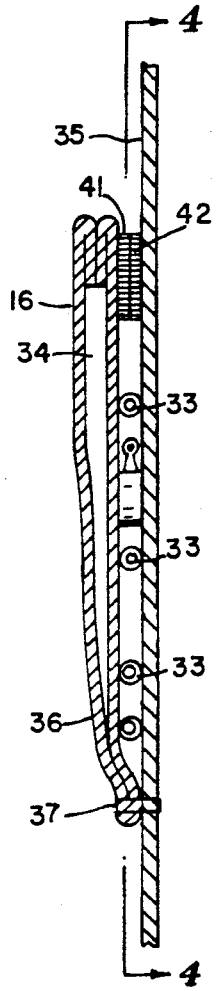
Fig. 5.
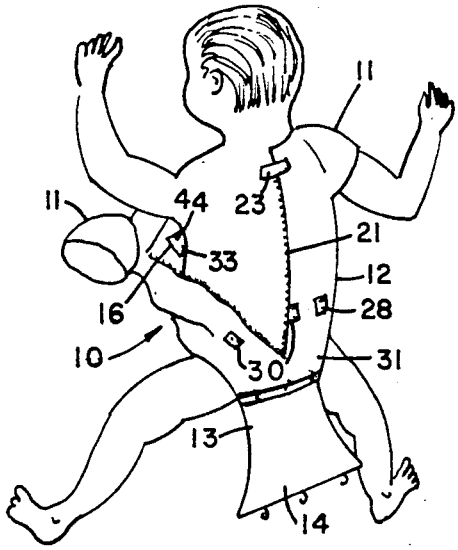
Fig. 6.

GARMENT FOR SHIELDING LINES CONNECTED TO A PATIENT

This is a continuation of my application Ser. No. 297,086, filed Jan. 13, 1989 (now abandoned).

BACKGROUND OF THE INVENTION

1. Field of the Invention

This invention generally relates to garments and more specifically to garments that are beneficial to patients with catheter implants or the like.

2. Description of Related Art

Reference is made to the following United States Letters Patent:

U.S. Pat. No. 4,688,270, (1987), Denicola et al

U.S. Pat. No. 4,698,848, (1987), Buckley

In a number of medical procedures it is advantageous to implant a catheter for an extended time interval, in the order of weeks, months and even years. During chemotherapy, for example, such an implant is desirable because it permits subsequent patient management on an outpatient basis. The patient returns to a medical facility for administration of the therapeutic agent through the catheter without having a needle inserted into a vein each time. Moreover, an implant makes it possible for the patient or an attendant to perform certain other procedures at home thereby reducing the number of times the patient must leave his or her residence. This is particularly advantageous when the patient is a small child.

Such implants necessitate a surgical procedure normally under general anesthesia. Typically the catheter is inserted under the skin of the chest wall and into a large vein that leads into the heart. An attendant catheter line is affixed to the catheter and must be held fast to the patient, normally by padding and tape adhered to the skin. This step is taken to assure that the patient does not dislodge the catheter by inadvertent manipulation of the catheter line.

Physicians sometimes are reluctant to use such an implant because it can impose some risk to the patient. Small children, particularly, are naturally inquisitive. Left unattended, they eventually begin playing with the catheter line, ripping the tape away from the skin causing irritation and increasing the risk of infection. Sometimes a child will open the catheter line and suffer blood loss or permit air to enter into the bloodstream. Children have been known to dislodge the catheter itself or even pull it out thereby imposing a serious medical condition, sometimes requiring another surgical procedure under unfavorable, emergency conditions.

Proposals have been made to counter this proclivity of small children to mishandle catheter lines. Early proposals included a number of restraints that inhibited a child's movement. However, these restraints have met with disfavor for obvious reasons.

The Denicola et al patent discloses a garment that differs from the general class of restraints. This garment shields an infant's head and hands from intravenous and gastrostomy lines infused into the infant during invasive therapy. A front opening vest with a series of tie tabs fully cover the trunk of an infant. Apertures in the vest allow infusion or other lines to be directed away from the child to other areas. This front opening vest fits around the neck and limbs and shields the lines below the vest from the patient's head and hands. Flaps anchor the lines to the vest to prevent the external portions of the lines from being pulled.

The Buckley patent discloses a front opening garment for adult patients with an open internal pocket for receiving a cardiac monitor or other similar device. This garment permits free patient movement with the monitor and provides a convenient method for caring such a monitor.

Both these garments are designed primarily for use in a hospital environment. For outpatient care, it still is typical for patients, particularly children who undergo this type of therapy to have the catheter line taped to their bodies. Regular cleaning and dressing procedures, required solely by this taping, are necessary to avoid skin rashes and infections. The risk still exists that a child will pull the dressing off irritating the skin area or open or dislodge the catheter, particularly if a child is unattended even for a short interval. As a result, medical personnel sometimes are reluctant to implant catheters in small children unless there is some assurance that the child will not play with the catheter thereby compounding the various risks normally associated with such implants. This generally means some assurance that the child will always be watched.

SUMMARY

Therefore it is an object of this invention to provide a garment for patients who have an implanted catheter and similar devices that are installed for a protracted interval.

Another object of this invention is to provide a garment particularly adapted for being worn by small children with implanted catheters.

Another object of this invention is to provide a garment for patients with implanted catheters that minimizes the chances for irritation and infection that would otherwise be possible.

Another object of this invention is to provide a garment particularly adapted for small children with implanted catheters that inhibits the child's access to the catheter line or catheter.

In accordance with this invention, a garment is designed as a normal, close fitting article of clothing with a pocket on the inside of the garment. The garment further includes head and limb openings that are separated from the vicinity of the catheter and are closely fitted to the neck and limbs. For small children the openings that facilitate dressing and undressing are constructed to be difficult for a child to open. This denies the child access to the catheter line through these openings thereby to prevent their grabbing and playing with the catheter line.

BRIEF DESCRIPTION OF THE DRAWINGS

This invention is pointed out with particularity in the appended claims. The various objects, advantages and novel features of this invention will be more fully apparent from a reading of the following detailed description taken in conjunction with the accompanying drawings in which like reference numerals refer to like parts, and in which:

FIG. 1 is a view of a garment constructed in accordance with this invention worn by a small child;

FIG. 2 is a back view of the garment shown in FIG. 1 in an open position;

FIG. 4 is a partial cross-sectional view taken along lines 4—4 in FIG. 5 to illustrate a pocket constructed in accordance with one aspect of this invention;

FIG. 5 is a cross-sectional view taken along lines 5—5 in FIG. 4; and

FIG. 6 depicts a small child with a partially removed garment that is constructed in accordance with this invention.

DESCRIPTION OF ILLUSTRATIVE EMBODIMENTS

Figure 3:
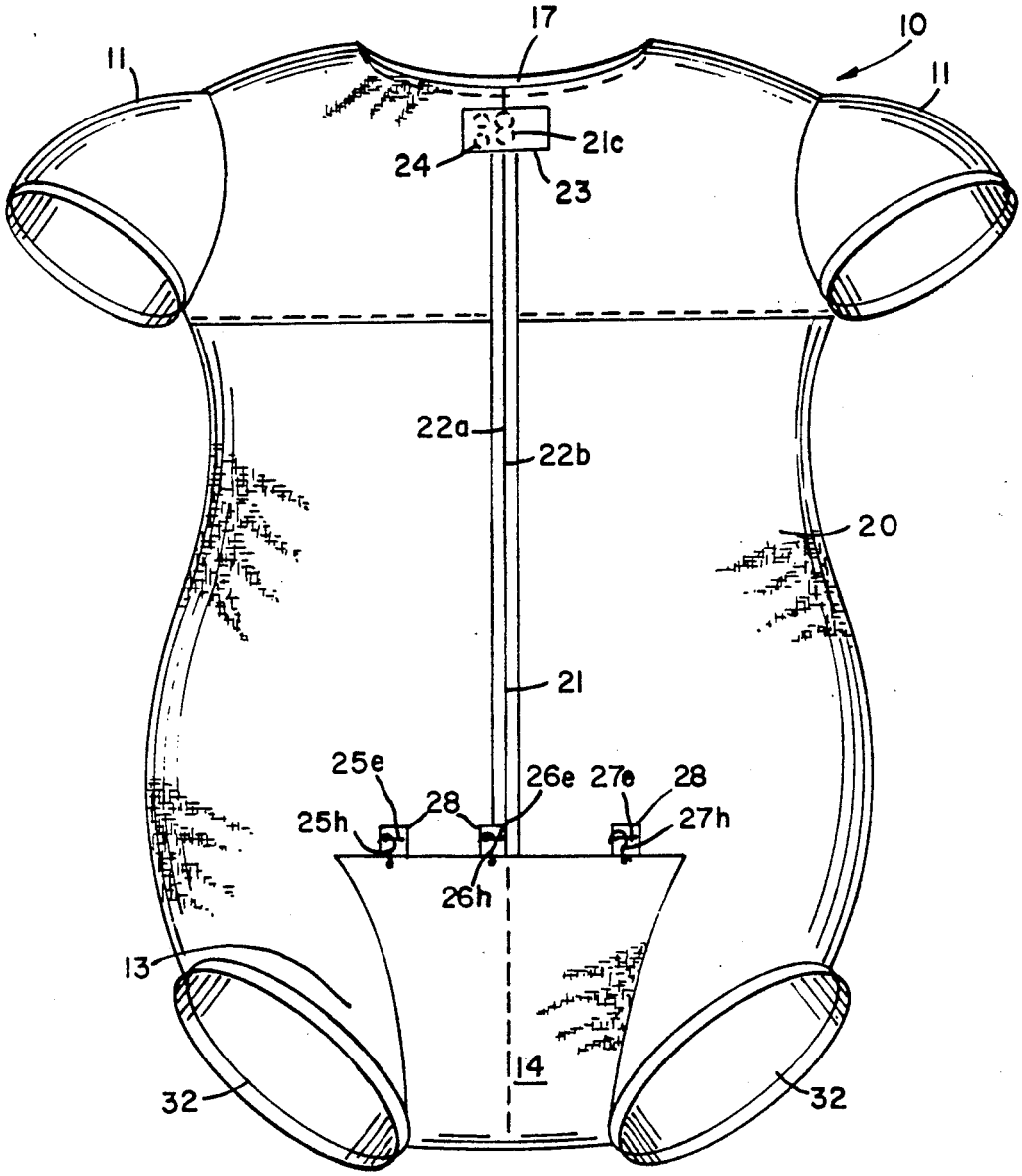
FIG. 3 is a back view of the garment shown in FIG. 1 in a closed position.

FIG. 1 specifically depicts a garment 10 in the form of a one-piece creeper to be worn by a small child. Normally, garment 10 will be constructed with soft cotton to maximize absorbency, comfort and the ability to launder the product at home. The garment 10 in FIG. 1 includes close-fitting short sleeves 11, a body portion 12 and an undercrotch portion 13 including a flap 14 sewn to the undercrotch portion 13 at a seam 15. The flap 14 passes beneath the crotch and connects to the back of the garment 10 as described later. A pocket 16 is sited to store a catheter line. The garment also has a close-fitting neck opening 17.

Referring now to FIGS. 2 and 3, a back portion 20 initially is opened by one of several possible garment closure means comprising a zipper 21, including tooth portions 21*a* and 21*b* and a slide 21*c*, is at a lower position (shown in FIG. 2) so edge flaps 22*a* and 22*b* separate. One edge flap, such as the edge flap 22*b*, can also include a protective strip 22*c*, shown partially in FIG. 2. This strip 22*c* is interposed between the zipper 21 and the child's skin to prevent the zipper from pinching the skin when the slide 21*c* is operated.

When the zipper slide 21*c* is moved to a top position, as shown in FIG. 3, the edge flaps 22*a* and 22*b* are pulled together. For small children the zipper slide 21*c* is hidden beneath a tab 23 that is sewn to one side of the garment and affixed to the other side by a fastener 24, such as hooks 24*h* and eyes 24*e* that are mounted on the tab 23 and the garment 10 respectively. This tab 23 constitutes a closure guard for this particular garment closure means. Given the difficulty for a child even to open the zipper 21, the addition of the tab 23 and the fasteners 24 provides a double closure for the back of the garment 10.

Still referring to FIGS. 2 and 3, the garment 10 has another garment closure means in the form of an opening at the undercrotch area 13 that also has a double closure. In this case the flap 14 constitutes a closure guard for this garment closure means. The flap 14 passes from the seam 15 (FIG. 1) at the garment through the crotch to the back 20 to be fastened by a hook and eye assembly. As shown in FIGS. 2 and 3, this assembly comprises hooks 25*h*, 26*h* and 27*h* sewn to the flap 14 and eyes 25*e*, 26*e*, and 27*e* sewn to strips of reinforcing tape 28 that are, in turn, sewn or otherwise affixed to the back 20 of the garment 10. For adults, one eye at each of the positions 25, 26 and 27 normally will be adequate. When the garment 10 is produced for children, the hooks 25*h*, 26*h* and 27*h* on the flap 14 engage corresponding sets of pairs of eyes.

When the garment 10 is designed for small children, the flap 14 covers a primary closure comprising a tape 29, shown in FIG. 2 that is sewn to the front of the garment at the undercrotch area 13. The tape carries one or two rows of eyes 30*e*. Hooks 30*h* are sewn to a tail 31 extending from the back 20 of the garment 10.

The two sets of eyes 25*e* and 30*e* shown in FIG. 2 accommodate different diaper sizes and child growth without having to replace the garment. Moreover, these two sets of eyes assure that the leg openings 32 fit closely to the child's legs.

There are several ways to dress a small child with this garment. Typically, the crotch closure is closed by engaging the hook and eye assembly 30. Then the garment is pulled onto the child's legs. Next the catheter line can be inserted in the pocket 16, as described later, and the arms directed through the sleeves. Finally, the zipper can be raised to close the back. The tab 23 is closed and the flap 14 is brought from the front of the garment 10 through the crotch area and fastened to the back 20 by hooks 25*h* and eyes 25*e*.

This garment 10 has no closure ties, and the closures at the back 20 formed by edges 22*a* and 22*b* and at the crotch by the flap 14 are both remote from the site of normal catheter implants.

When these openings are closed and the neck 17, sleeves 11 and leg openings 32 closely fit around the child's neck and limbs, the garment denies access to its interior. More specifically, small children do not have the coordination that is necessary to use both their hands to open the tab 23 at the neck. Moreover, even if they were successful in removing the tab 23, it would be difficult for the child to pull the zipper 21 down the back of the garment 10; thus access effectively is inhibited through the neck 17. The sleeves are close-fitting so there is no access through the sleeve openings. Finally, a small child will not be able to release both the flap 14 and the tail 31 and reach up through the bottom of the garment.

Thus, in accordance with one aspect of this invention access inside the garment is effectively denied to the child, so the child can not reach an implanted catheter or catheter line either to play with it or pull on it. However, this objective is achieved without imposing any restraints on a child's activities.

Access to the catheter line is further denied by the pocket 16 as shown generally in FIGS. 1 and 2 and in detail in FIGS. 4 and 5. Normally the pocket 16 will be positioned immediately below the site of the catheter implant, so a line 33 from the catheter extends downwards toward the pocket 16. In this embodiment the pocket 16 comprises an integral, double walled structure 34 that is sewn at the bottom and two side edges to an inside front surface 35 of the garment 10. As apparent, the pocket 16 has an opening facing and proximate the implant site.

In this particularly disclosed pocket 16 the double walled structure 34 comprises a folded piece of fabric 36 initially sewn around the bottom and side edges with the wrong side of the material to the outside. This forms an integral pocket wall means in the form of a double structure that is then turned right-side out. The edges at the remaining opening are turned in and sewn together. This integral double structure 34 is then sewn to the inside front surface 35 through a hem 37 at the bottom edge and along the side edges to form a pocket means with an open top along a loose edge of the structure 34. As a result, all raw edges are completely enclosed internally of the double wall structure 34. All stitching used in the structure 34 and used to affix the structure 34 to the inside front surface 35 is outside the cavity formed by the pocket 16. Any threads or materials that might unravel are isolated from the pocket 16, so they will not tangle with the catheter line 33 or any elements with the catheter line 33, such as a valve 40.

The double wall structure 34 lies between the patient and the catheter line 33. This eases any discomfort that might otherwise exist when a patient, particularly a small child, sleeps in the prone position. Alternate double wall structures are also possible. Moreover, single wall structures might be used provided the structure cushions the catheter line 33 and has no parts that might entangle the catheter line 33 or valve 40.

In this particular embodiment Velcro® fasteners with oppositely faced hook tabs 41 and pile tabs 42 are positioned at the top to leave an intermediate space on gap 43 therebetween thereby to form partial closure means connected to the pocket. More specifically, the tabs 41 are affixed to the inside front surface 35 of the garment while the tabs 42 are affixed to a counterfacing, inside surface of the pocket 16 adjacent the top opening across the loose edge of the structure 34.

In use a portion of the catheter line 33 is coiled and positioned inside the pocket 16; then the tabs 41 and 42 are closed together to reduce the opening at the pocket without fully closing it. The gap 43 permits the child to move freely because the line 33 can move within the pocket 16 under normal activity. Yet, The pocket 16 with the reduced opening retains the catheter line within the pocket 16. Thus, the child can not grasp the catheter line and pull it completely out of the pocket 16 because the body portion 12 is also close-fitting. Thus, the pocket 16 limits motion of the catheter line 33.

FIG. 6 is useful in understanding how medical personnel, parents or others can readily access the catheter line 33 extending from a catheter implant site. Referring to FIGS. 2 and 6, it is merely necessary to release the tab 23 and partially open the zipper 21, to remove the right or left arm (the left arm in FIG. 6) from the sleeve 11 and to peel back the front of the garment 10 to expose the pocket 16 and the implant site (not visible in FIG. 6, but normally in the chest wall.) An adult can separate the tabs 41 and 42 to open the pocket 16 with one hand and then remove the line 33 while supporting the child with the other hand. This is particularly advantageous in the home environment where parents administer anticoagulants or other medicines or partially bathe the child. Then the line 33 is easily reinserted into the pocket 16. The tabs 41 and 42 are moved together to close the pocket 16 and the child is redressed.

In summary a garment constructed in accordance with this invention securely holds a catheter line without imposing any restrictions on the child's movement. The close fitting nature of the garment 10, the closures, and the guards against opening of the closures combine to eliminate the need for continuous supervision of a child. The closure at the undercrotch portion 13 shown in FIGS. 2 and 3 is particularly advantageous with small children because diapers can be changed without having to remove the garment and therefor disturb the catheter line. A single closure at the undercrotch area could be used for a garment for adults.

Moreover this garment 10 eliminates many uncomfortable procedures that are otherwise required. It is not necessary to tape the catheter line 33 to the patient's skin; so problems of rashes and potentials for infection and bleeding are eliminated. Similarly, expenses for tape, bandages, gauze, antiseptic solutions and related items are eliminated.

Modifications can be made so this garment. For example, the depicted garment fits snugly around the legs. It is possible to construct the garment to fit loosely at the legs. Even with a loose fit, a child is still blocked from accessing the catheter line through the bottom of the garment by the double closure. It is also possible to construct a garment with a pocket and closure separated from the position of the catheter, but without the closure guards. Such a garment can be advantageously used by older patients with catheter lines or the like. Different pocket constructions may also be substituted using, for example, single or double pocket structures. Still other modifications can be made to the disclosed garment. Therefore, it is the intent of the appended claims to cover all such variations and modifications as come within the true spirit and scope of this invention.

What is claimed as new and desired to be secured by Letters Patent of the United States is:

1. A garment to be worn by a person with a catheter and catheter line or the like implanted at an implant site, said garment comprising:

A. close-fitting garment body means with an inside surface for covering a portion of the person including the implant site, B. pocket forming means having a loose edge and having other edges mounted to said garment body means on said inside surface adjacent the implant site for forming with said garment body means a pocket with an opening along said loose edge facing and proximate the implant site for storing a portion of the catheter line or the like therein, C. first partial closure means attached to said pocket forming means along substantially all said loose edge and second partial closure means attached to said garment body means opposite to said first partial closure means for releasable attachment thereto, said first and second partial closure means having a gap therethrough into said pocket and partially closing said opening around said gap to retain the catheter line or the like in said pocket means while allowing the catheter line limited motion relative to said garment through said gap in said partial closure means, and D. garment closure means affixed to said garment body means for facilitating the removal and donning of the garment, said closure means being offset from the site of said pocket means.

2. A garment as recited in claim 1 wherein said pocket forming means comprises integral pocket wall means affixed to said inside surface of said garment body means proximate the implant site thereby to form said pocket means.

3. A garment as recited in claim 2 wherein said first partial closure means includes spaced first fastening means on said integral pocket wall means at said loose edge and said second partial closure means comprises spaced second fastening means on said garment means that are opposite said first fastening means for partially closing said pocket means at said pocket opening.

4. A garment to be worn by a person with an implanted catheter or the like at an implant site and an attached line extending therefrom, said garment comprising:

A. garment body means with inside and outside surfaces for covering the person's trunk including the implant site, B. garment closure means affixed to said garment body means for closely fitting said garment body means on the person's trunk, C. pocket forming means connected to the inside surface of said garment body means adjacent the implant site for forming with coextensive portions of said garment body means a pocket means with an opening at a loose edge of said pocket forming means facing and proximate the implant site, said pocket means being formed for storing a portion of the line therein, D. first and second partial closure means attached to said pocket forming means along said loose edge thereof and oppositely on said garment body means for closing said loose edge against said garment means, said partial closure means having a gap therethrough into said pocket to enable limited catheter line motion relative to said garment, and E. guard means attached to said garment body means at said garment closure means for inhibiting the person from accessing said garment closure means thereby to inhibit the person from handling the catheter line.

5. A garment as recited in claim 4 wherein said pocket forming means comprises an integral pocket wall structure affixed to said inside surface of said garment body means.

6. A garment as recited in claim 5 wherein said integral pocket wall structure comprises first and second layers of material sewn to said garment body portion.

7. A garment as recited in claim 6 wherein said first and second partial closure means comprise first and second spaced closure means at said pocket opening for partially closing said opening around the catheter line leading from the implant site to said pocket.

8. A garment as recited in claim 4 wherein said garment body means includes:

i. edge flap means for facilitating the donning of said garment, ii. zipper means connected to said edge flap means with slide means for moving from an opened to a closed position to adjoin said edge flap means, and iii. means for covering said slide means when said slide means closes said zipper means.

9. A garment as recited in claim 4 wherein said garment body means includes i. first and second separated adjacent portions for providing access inside said garment, ii. means on said adjacent portions for closing said adjacent portions of said garment body iii. flap means having one end connected to said garment, and iv. means on said flap means and said garment means for closing said flap means to said garment means with said flap means overlying said first means thereby to inhibit access to said closing means.

10. A garment as recited in claim 4 wherein said garment body means has first and second access openings displaced from the site of said pocket forming means and includes:

i. first closure means for closing said first access opening, and ii. second closure means for closing said second access opening

11. A garment as recited in claim 10 wherein first and second guard means overly each of said first and second closure means respectively for inhibiting access thereto.

12. A garment as recited in claim 4 wherein the person has a trunk, neck and limbs and the implant site is located on the person's trunk, said garment body means being close-fitting to the person's trunk and having close fitting openings for the person's neck and limbs.

* * * * *